United States Patent [19]

Eguchi et al.

[11] Patent Number: 4,458,613

[45] Date of Patent: Jul. 10, 1984

[54] SEWING MACHINE WITH BOBBIN THREAD TENSION ADJUSTING DEVICE

[75] Inventors: Yasukata Eguchi; Susumu Hanyu; Shuzou Morimoto, all of Tokyo, Japan

[73] Assignee: Janome Sewing Machine Co., Ltd., Tokyo, Japan

[21] Appl. No.: 255,727

[22] Filed: Apr. 20, 1981

[30] Foreign Application Priority Data

Apr. 24, 1980 [JP] Japan ..... 55-53631

[51] Int. Cl.[3] ..... D05B 63/00; D05B 1/12

[52] U.S. Cl. ..... 112/184; 112/229; 112/255

[58] Field of Search ..... 112/181, 182, 183, 184, 112/229, 254, 255

[56] References Cited

U.S. PATENT DOCUMENTS

| | | | |
|---|---|---|---|
| 328,688 | 10/1885 | Keeler | 112/255 |
| 875,603 | 12/1907 | Parkes | 112/229 |
| 875,613 | 12/1907 | Parkes | 112/229 |
| 1,007,837 | 11/1911 | Almond | 112/255 |
| 2,975,738 | 3/1961 | Hoppe | 112/254 X |
| 3,050,021 | 8/1962 | Fukushima | 112/229 |
| 3,366,082 | 1/1968 | Ross | 112/184 X |
| 3,856,233 | 12/1974 | Thomas | 112/254 X |
| 3,996,866 | 12/1976 | Bianchi | 112/254 |
| 4,182,250 | 1/1980 | Johnson | 112/184 |

FOREIGN PATENT DOCUMENTS

| | | | |
|---|---|---|---|
| 23486 | of 1883 | Fed. Rep. of Germany | 112/254 |

*Primary Examiner*—Wm. Carter Reynolds
*Attorney, Agent, or Firm*—Michael J. Striker

[57] ABSTRACT

A sewing machine having a drive shaft rotated by a machine motor to vertically reciprocate a needle carrying an upper thread is provided with a device for adjusting the tension of a lower thread pulled out from a bobbin located in a bobbin carrier of the sewing machine. The device includes a tension lever cooperated with a spring element, and a releasing lever which is in engagement with a cam rotated by the drive shaft. The position of the tension lever relative to the lower thread is effected by a manually operated dial and a cam engageable with the spring element. The releasing lever is adapted to intermittently release the tension lever from the lower thread during the stitching operation.

2 Claims, 8 Drawing Figures

SEWING MACHINE WITH BOBBIN THREAD TENSION ADJUSTING DEVICE

BACKGROUND OF THE INVENTION

Brief Description of the Invention

The invention relates to a sewing machine, and more particularly relates to a bobbin thread tension adjusting device of a sewing machine which is operated in a timed relation with rotation of an upper drive shaft of the sewing machine to intermittently give a predetermined suitable bobbin thread tension during the stitching operation, thereby to produce proper stitches in dependence upon a kind of fabric to be sewn. For attaining this object, a bobbin thread tension lever is provided. The lever is normally biased in one direction by a spring to give a predetermined amount of pressure against the bobbin thread. A release device is operated in a timed relation with the upper drive shaft of the sewing machine to intermittently release the bobbin thread tension lever to an inoperative position during the stitching operation. A manually accessible device is operated to optionally adjust the bobbin thread tension.

According to conventional sewing machine, it has been possible to adjust tension of the upper thread by manipulating an external operating part such as a dial 40 as shown in FIGS. 6 and 7. It has, however, been impossible to adjust the tension of the bobbin or lower thread from the outside of the sewing machine. The tension adjustment of the bobbin thread has required the machine operator, for example, to take out a bobbin case, which is normally positioned in a loop taker, from the sewing machine, and then to adjust a tension of a spring (41) as shown in FIG. 6 which is provided on the bobbin case at the outlet thereof from which the bobbin thread is pulled out. Such an operation is very troublesome and time consuming for a machine operator. In any events, it has been difficult to adjust the bobbin thread from the outside of the sewing machine due to the structure of the loop taker, because the bobbin loaded with the lower thread is positioned in the loop taker and therefore the bobbin thread tension element has to be provided in the loop taker mechanism in such a manner that it may not hinder the passage of the upper thread loop around the loop taker as the loop is taken by the loop taker and enlarged therearound, and because it is also difficult to connect such a bobbin thread tension element to the external operating part.

SUMMARY OF THE INVENTION

The present invention has been provided to eliminate the defects and disadvantages of the prior art. It is a primary object of the invention to provide a bobbin thread tension adjusting device of a sewing machine which is simple in structure and easy in operation.

It is another object of the invention to adjust the tension of the bobbin thread even during the stitching operation of the sewing machine.

It is still another object of the invention to heighten the efficiency of the stitching operation.

The other features and advantages of the invention will be apparent from the following description of the embodiments in reference to the attached drawings.

DETAIL DESCRIPTION OF THE INVENTION

Figure 1:
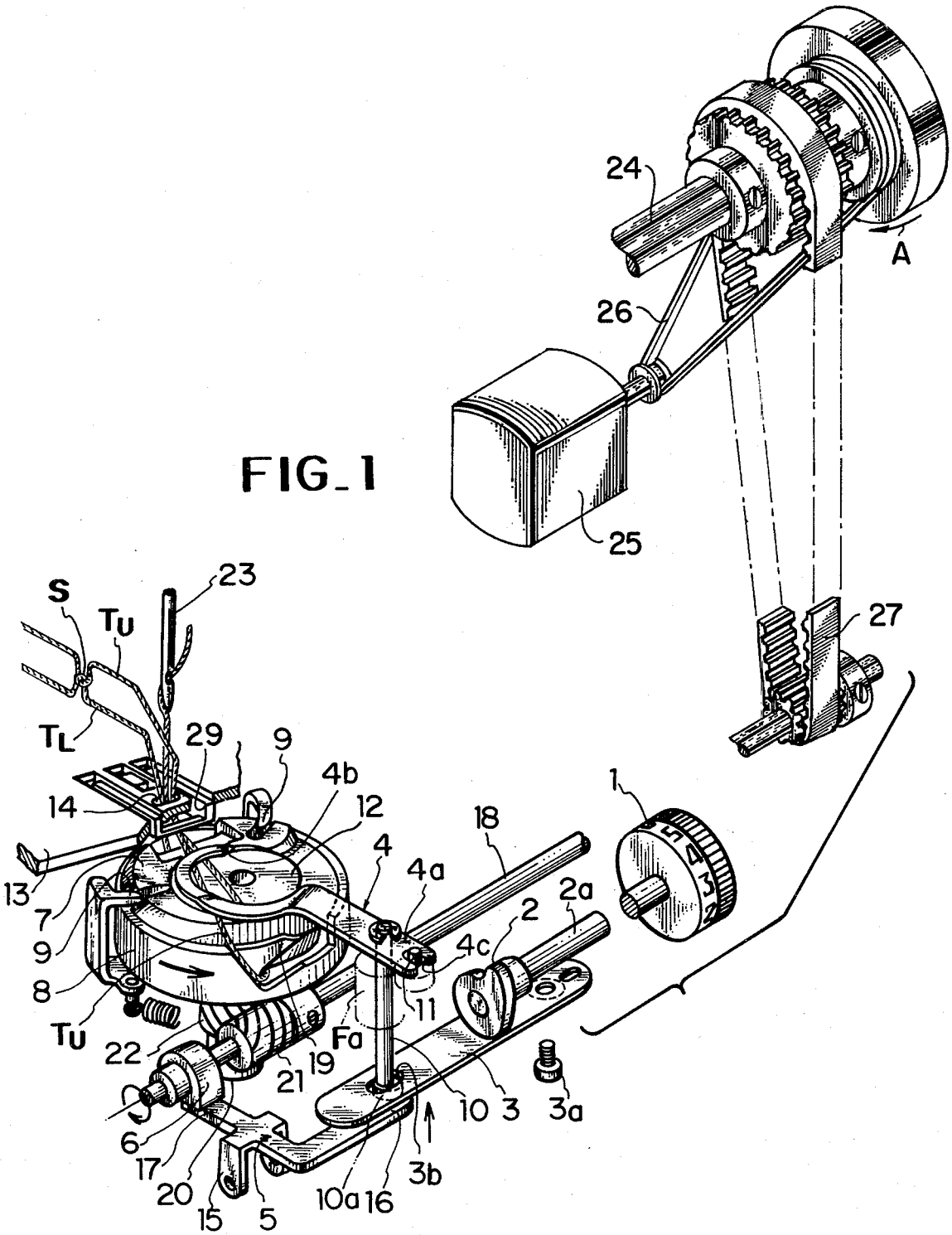
FIG. 1 is a perspective view of the invention in one phase of operation.

In reference to FIGS. 1–3 and 7, an operating dial 1 is provided in a front face of a sewing machine F and is accessible by a machine operator. The operating dial 1 is secured to one end of a shaft 2*a*. The shaft 2*a* has a cam 2 secured to the other end thereof which is to be rotated by operation of the dial 1. An elongated plate spring 3 is located beneath the cam 2 and is at one end thereof secured by a screw 3*a* to a suitable place of the housing F within the sewing machine. The plate spring 3 is formed with an opening 3*b* at the free end part thereof. A lever 4 is at a base 4*a* thereof secured to the upper end of a vertical rod 10 which is vertically slidable in a part of the machine housing F. The lever 4 is formed at one end thereof with a semicircular arm 4*b* for applying a restraining pressure to a bobbin thread $T_L$ which is drawn out from a bobbin 12 towards a needle hole 14 of a needle plate 13. The lever 4 is formed at the other end thereof with a cutout 4*c*. A vertical pin 11 secured to the machine housing is inserted into the cutout 4*c* of the lever 4 for guiding the vertical displacement of the latter.

Another lever 5 is at the intermediate lower directed parts 15 thereof turnably mounted to the machine housing. The lever 5 has one arm 16 extended beneath the plate spring 3. The free end of the arm 16 is located beneath the lower end of the vertical rod 10, which is inserted into the opening 3*b* of the plate spring 3 and is provided with a flange 10*a*. The lever 5 has the opposite arm 17 which is in engagement with a cam 6 which is secured to one end of a shaft 18.

The bobbin 12, which is loaded with the lower thread $T_L$, is positioned in a bobbin carrier 7, which is of a semicircular configuration and is located in a cup-shaped loop taker 8 which is provided with a loop catching hook 19 and rotated in a horizontal plane. The bobbin carrier 7 is prevented from rotation together with the loop taker 8 by a pair of retainer elements 9, 9 alternately rocked to retain the bobbin carrier 7 during the stitching operation. The loop taker 8 is rotated by a vertical shaft 20 which is provided with a gear 22. The gear 22 is in mesh with a gear 21 secured to the shaft 18.

A needle 23 is attached to the lower end of a needle bar (not shown) which is vertically reciprocated by a drive shaft 24 of the sewing machine which is rotated in the direction of arrow A by an electric machine motor 25 and transmission belt 26 in the known fashion. The lower shaft 18 is connected to the drive shaft by a belt 27 and is rotated to rotate the loop taker 8 while the drive shaft makes one complete rotation. An upper thread $T_U$ is guided to the needle 23 from an upper thread supply (not shown) through a thread tension, a thread take-up lever, etc., though those are not shown. The upper thread $T_U$ is progressively drawn out from the thread supply by the vertical reciprocation of the needle and the fabric feeding movement of the feed dog 29 (not shown) during the stitching operation to form stitches S together with the bobbin thread $T_L$.

Figure 4:
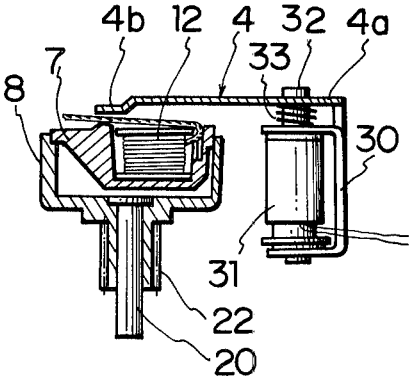
FIG. 4 is a side elevational view of another embodiment of the invention partly shown in section.

FIG. 4 shows another embodiment of the invention, in which the lever 4 is secured to a plunger 32 of a solenoid 31 mounted on a frame 30 which is fixedly mounted to the machine housing F. The solenoid 31 is energized to pull down the plunger 32 against the action of a spring 33, thereby to displace the lever 4 towards the bobbin 12, so that the semicircular arm **4*b* of the lever 4 may press against the bobbin thread $T_L$. When the solenoid is deenergized, the plunger 32 is returned up by the action of the spring 33. The solenoid 31 is intermittently energized by a signal from an electronic memory which is generated in synchronism with rotation of the drive shaft of the sewing machine with the detection of the angular position thereof by a sensor. The pressure of the lever 4 against the bobbin thread $T_L$ may be varied with adjustment of the voltage supplied to the solenoid 31** by way of an external operating part.

Figure 5:
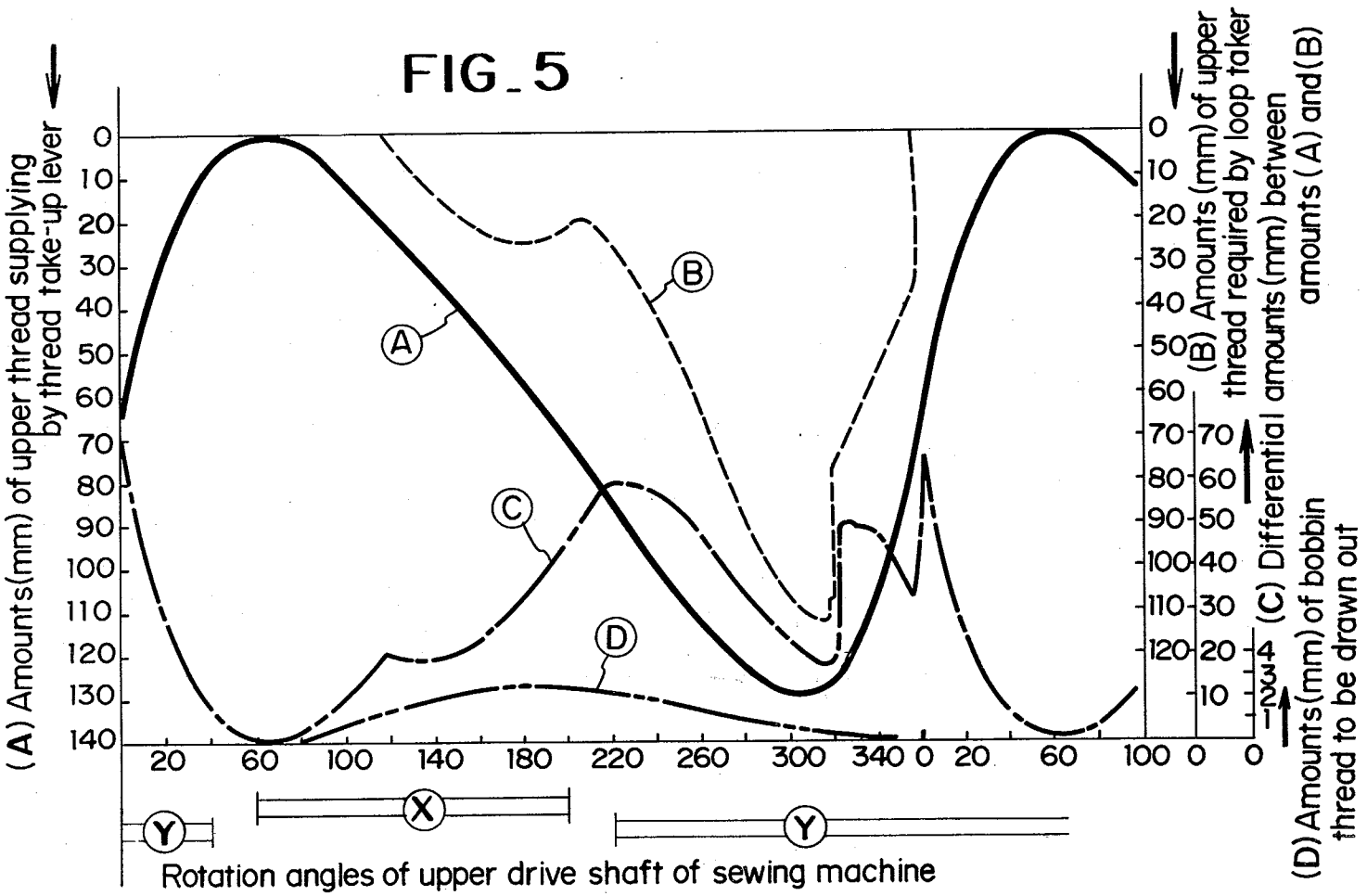
FIG. 5 is a motion diagram of a sewing machine incorporated with the present invention.

FIG. 5 shows a motion diagram of a sewing machine, in which the rotation angles of the drive shaft of sewing machine are laterally indicated, starting from 0° corresponding to the upper dead point of the needle. Vertically indicated are amounts (A) of upper thread supplied by the thread take-up lever, amounts (B) of upper thread required by the loop taker, the differential amounts (C) of upper thread between the amounts (A) and (B), and amounts (D) of bobbin thread to be drawn out. These amounts of upper and bobbin threads are shown by the curves (A)–(D) respectively. In the lateral period (X), the lever 4 is operated to give a restraining pressure to the bobbin thread, and in the period (Y), the lever 4 is released to give no restraining pressure to the bobbin thread.

Figure 2:
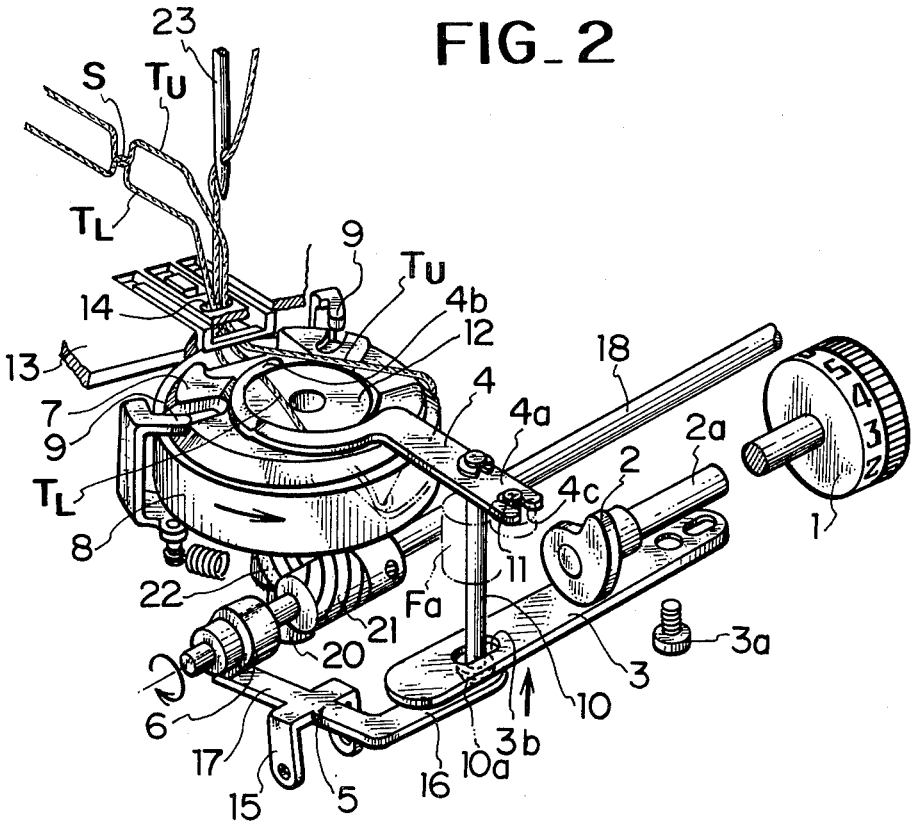
FIG. 2 is a perspective view of the invention in another phase of operation.
Figure 3:
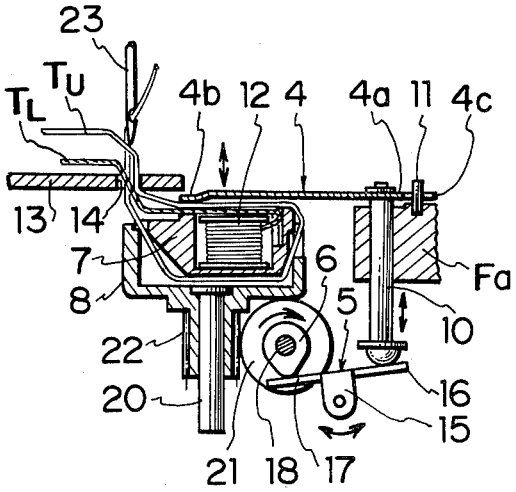
FIG. 3 is a side elevational view of the invention partly shown in section.

Operation of the invention is as follows; If the sewing machine is driven, the upper drive shaft is rotated to vertically reciprocate the needle 23 and rotate the loop taker 8. With the cooperation of the needle and the loop taker, the upper thread $T_U$ and the bobbin thread $T_L$ are intersected. Then as the fabric is transported by the feed dog, the lock stitch S is produced as shown in FIGS. 1 and 2.

In the period (X) of rotation angles from 60° to 200° of the upper drive shaft of sewing machine, the needle 23 starts to descend to the lower dead point thereof and comes to be on the way to ascend therefrom. In the meantime, the cam 6, which is rotated by the vertical loop shaft 20, gives no influence to the lever 5, and therefore the semicircular arm **4*b* of the lever 4 is pressed against the bobbin thread $T_L$, since the lever 4 is biased in the downward direction by way of the vertical rod 10 which is normally pressed down by the plate spring 3 which is acted upon by the cam 2 as shown in FIG. 1**.

In the period of rotation angles 220°–400° (40° in the second rotation) of the upper drive shaft, the hook 19 of the loop taker 8 catches the upper thread loop and enlarges the same therearound while the needle 23 ascends to the upper dead point thereof and starts to descend again. In the meantime, the cam 6 turns the lever 5 in the counterclockwise direction (in FIGS. 2 and 3), and therefore the lever 5 pushes up the vertical rod 10 against the action of plate spring 3. Then the semicircular arm **4*b* of the lever 4** is displaced in the upper direction and releases the bobbin thread $T_L$, and at the same time provides a path for the upper thread loop to pass therethrough.

The tension of the bobbin thread $T_L$ may be optionally varied by rotating the operating dial 1. Namely in dependence upon the rotation of the operating dial 1 in one or the other direction, the cam 2 is rotated as accordingly and varies a pressure against the plate spring 3. Such an adjustable pressure applied to the plate spring 3 is transmitted to the lever 4 via the vertical rod 10. Thus the semicircular arm **4*b* of lever retains the bobbin thread $T_L$ with a pressure determined by the cam 2**.

Figure 6:
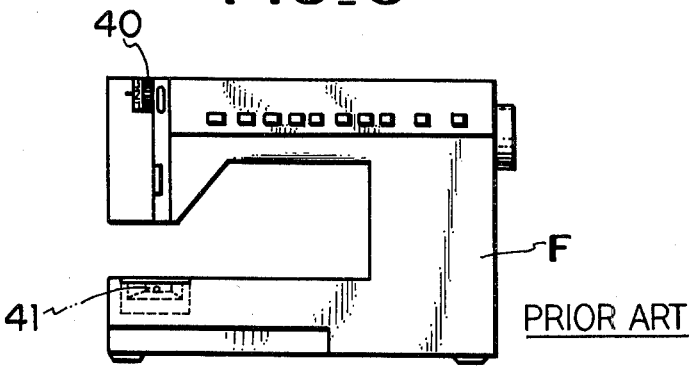
FIG. 6 is a front elevational view of a conventional sewing machine.
Figure 7:
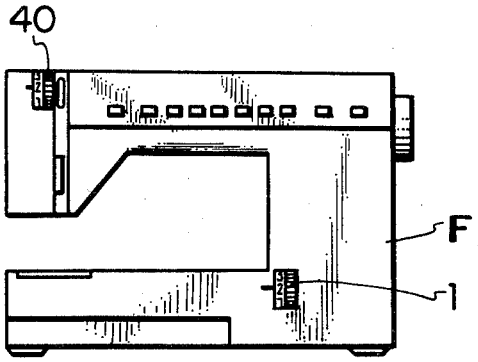
FIG. 7 is a front elevational view of a sewing machine with an operating dial according to the present invention.
Figure 8:
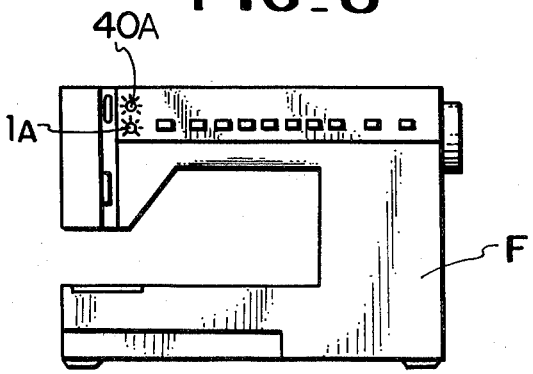
FIG. 8 is a front elevational view of a sewing machine with the operating dial according to another embodiment of the invention.

As to another embodiment of the invention incorporated with the solenoid 31 as shown in FIG. 4, an operating part 1A is provided on a suitable part of the sewing machine as shown in FIG. 8 for controlling the voltage supplied to the solenoid 31 to adjust the tension of the bobbin thread. Since the solenoid 31 is energized in a timed relation with rotation of the upper drive shaft of the sewing machine with the detection of the angular position thereof by a sensor, the lever 4 provides a path for the upper thread loop to pass therethrough. Reference numbers 40 "in" FIGS. 6,7 and 40A in FIG. 8 identify means for adjusting the tension of the upper thread.

It will be understood that each of the elements described above, or two or more together, may also find a useful application in other types of sewing machines differing from the types described above.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a sewing machine having a housing and an upper drive shaft mounted on the housing and rotated by a machine motor to vertically reciprocate a needle carrying an upper thread and transport a fabric by means of a feed dog in a timed relation with the needle, a combination comprising a loop taker rotated by the upper drive shaft in a timed relation with the movement of the needle to catch and enlarge a loop of the upper thread therearound; a bobbin carrier located in said loop taker; a bobbin positioned within said bobbin carrier and carrying a lower thread supplied to the upper thread to produce stitches together with the same; lower thread retaining means operative for applying a restraining pressure to the lower thread and biased in a direction of applying of said pressure so as to give a predetermined amount of tension to the lower thread; releasing means operative in a timed relation with the upper drive shaft for intermittently releasing said retaining means from the lower thread; and lower thread adjusting means operatively connected to said retaining means for adjusting the tension to the lower thread; said retaining means including a tension lever adapted to apply said pressure to the lower thread and a spring member arranged for normally pressing said tension lever against the lower thread, and said releasing means including a releasing lever turnably mounted on said housing and a cam engageable with said releasing lever and adapted to rotate in a timed relation with said upper drive shaft, said releasing lever being adapted to cooperate with said tension lever for intermittently displacing the latter against the action of said spring member, said adjusting means including a tension adjusting cam arranged in engagement with said spring member and an operating dial operatively connected to said tension adjusting cam and manually operated to vary the position of said tension adjusting cam relative to said spring member.

2. The combination of claim 1, wherein said adjusting means are manually operated.

* * * * *